US005868145A

United States Patent [19]

Spann

[11] Patent Number: 5,868,145

[45] Date of Patent: Feb. 9, 1999

[54] HAIR EXTENSION AND THICKENING PROCESS

[76] Inventor: Carolyn H. Spann, 545 Riverbirch Trace, Stone Mountain, Ga. 30087

[21] Appl. No.: 80,596

[22] Filed: May 18, 1998

Related U.S. Application Data

[60] Provisional application No. 60/047,044 May 19, 1997.

[51] Int. Cl.[6] ..... A41G 3/00

[52] U.S. Cl. ..... 132/201

[58] Field of Search ..... 132/201, 53, 54, 132/56; 623/15; 446/394

[56] References Cited

U.S. PATENT DOCUMENTS

| | | | |
|---|---|---|---|
| 3,295,534 | 1/1967 | Dorkin . | |
| 3,530,862 | 9/1970 | Hudson . | |
| 3,642,010 | 2/1972 | Kuris | 132/201 |
| 4,934,387 | 6/1990 | Megna . | |
| 4,947,877 | 8/1990 | Meyer et al. . | |
| 4,982,748 | 1/1991 | Trimarchi . | |
| 5,072,745 | 12/1991 | Cheh . | |
| 5,082,010 | 1/1992 | Skaryd et al. | 132/201 |
| 5,107,867 | 4/1992 | Barrington . | |
| 5,121,761 | 6/1992 | Meister . | |
| 5,413,124 | 5/1995 | Incando | 132/201 |
| 5,521,228 | 5/1996 | Weber et al. . | |

*Primary Examiner*—Todd E. Manahan
*Assistant Examiner*—Eduardo C. Robert
*Attorney, Agent, or Firm*—Hughes & Kaplan; Barry E. Kaplan

[57] ABSTRACT

Disclosed is an improved hair extension and thickening process which reduces shedding, resists physical and chemical degradation, and which, further, provides for safely, easily, and cleanly removing the supplemental hair from the natural hair. A weft of natural or synthetic supplemental hair is suspended upon a mounting surface. A small bundle of supplemental hair is segregated from the weft. A liquid latex is applied thereto, and the latex is twisted into it so that the supplemental hair is thoroughly coated, intertwined, and bonded together at the junction so formed. Cyanoacrylate adhesive is applied to further bond the bundle of supplemental hair. The supplemental bundles are then permanently separated from the weft. The supplemental bundle may later be bonded to a person's natural hair through the use of a hot melt acrylic adhesive. Release and separation of the supplemental bundle from the person's natural hair is conveniently, safely, and cleanly obtained through the use of acetone.

12 Claims, 3 Drawing Sheets

HAIR EXTENSION AND THICKENING PROCESS

RELATED APPLICATIONS

The inventor hereof claims priority based upon and pursuant to provisional patent application Ser. No. 60/047,044 filed on May 19, 1997.

BACKGROUND OF THE INVENTION

1. Field of the Invention

This invention relates generally to hair extension and thickening processes, sometimes also called hair infusion; and, more particularly, to an improved process for extending and thickening human hair in which a bundle of supplemental hair is preformed through the use of liquid latex and cyanoacrylate adhesive. The supplemental bundle is then bonded to the human hair through the use of a hot melt acrylic adhesive. Release of the supplemental bundle is conveniently and cleanly obtained by the use of acetone.

2. Description of Background Art

Persons with short hair, thinning hair, or those otherwise seeking to change their appearance, sometimes desire to lengthen or supplement their natural hair. Accordingly, various processes have been developed for extending and thickening the natural hair. These processes are sometimes known in the industry by the term, hair infusion.

Such processes seek to provide a longer, fuller, healthier appearance to the natural hair. Such processes, by various means, add supplemental hair to the natural hair. Examples of some such processes may be reviewed by reference to the following U.S. Pat. Nos. 5,121,761 to Meister; 5,072,745 to Cheh; 4,982,748 to Trimarchi; 4,947,877 to Meyer et al.; 4,934,387 to Megna; and, 3,295,534 to Dorkin.

Persons seeking such hair additions may spend hundreds of dollars, and invest many hours of time with a stylist, in order to achieve a longer and fuller style. Notwithstanding this investment, they may experience significant shedding of the supplemental hair within a few days following the application process. The problem is further compounded over time by the use of chemical treatments, shampoos and conditioners, blow-dryers, brushes, combs, and the like, and by swimming and sunning, all of which tend to degrade the adhesive junction between the person's natural hair and the supplemental hair. Such shedding is frustrating not only to the person undergoing the process, but also to the stylist who has invested significant time, energy, and creativity in fulfilling the needs of the client, and who has put his or her reputation at stake should the process fail to meet the expectations of the client.

Others have recognized and attempted to provide solutions to these difficulties. In U.S. Pat. No. 5,107,867 issued to Barrington on Apr. 28, 1992, for example, supplemental hair plugs are formed by the use of a cyanoacrylate adhesive. The tip of the plug is coated with hot melt glue and allowed to cool. The plug is then threaded, along with the person's natural hair, into a section of heat shrink tubing. Heat is then applied, which liquefies the hot melt glue, thereby joining the natural and supplemental hair. The heat further serves to shrink the tubing about the junction to compress and seal the junction.

When it is desired to remove the supplemental hair from the person's natural air, the junction is again heated. Because hot melt adhesives are used to bond the supplemental hair to the natural hair, however, the process of removing the supplemental hair may leave an undesirable, sticky residue upon the person's natural hair.

Thus, it is readily apparent that an improved hair extension and thickening process which reduces shedding, resists physical and chemical degradation, and which, further, provides for safely, easily, and cleanly removing the supplemental hair from the natural hair, is needed. It is, therefore, to the provision of such an improved hair extension and thickening process that the method of the present invention is directed.

Accordingly, the several objects of the present invention are;

- to provide an improved hair extension and thickening process which can be used to improve various methods of adding length or volume, or both, to natural hair or hair prostheses;
- to provide an improved hair extension and thickening process which will not shed for extended periods of time, even through frequent washings and active wear;
- to provide an improved hair extension and thickening process which provides for safely, easily, and cleanly removing the supplemental hair from the natural hair; and,
- to provide an improved hair extension and thickening process which saves money and time by allowing the stylist to work faster and to use fewer materials.

Other objects, features, and advantages of the process of the present invention will become apparent to those skilled in the art by reference to the drawings and to the following detailed description of the preferred embodiment presented herein.

BRIEF SUMMARY OF THE INVENTION

In accordance with the several objects of this invention, presented is an improved hair extension and thickening process which reduces shedding, resists physical and chemical degradation, and which, further, provides for safely, easily, and cleanly removing the supplemental hair from the natural hair. In accordance with the process of the present invention, a supplemental bundle of hair is pre-formed through the use of liquid latex and cyanoacrylate adhesive.

The process provides that a weft of natural or synthetic supplemental hair is suspended upon a mounting surface. A small bundle of supplemental hair is segregated from the weft. A liquid latex is applied to this small bundle, and the latex is twisted into it so that the supplemental hair is thoroughly coated, intertwined, and bonded together at the junction so formed. When the latex component dries, cyanoacrylate adhesive is applied to further bond the supplemental bundle of hair together. The process is repeated across the weft. The supplemental bundles are then permanently separated from the weft. The supplemental bundle may later be bonded to a person's natural hair through the use of a hot melt acrylic adhesive. Release and separation of the supplemental bundle from the person's natural hair is conveniently, safely, and cleanly obtained through the use of acetone.

An advantage to be found within the hair extension and thickening process of the present invention is that the liquid latex component, which is neither harmful to the skin of the person preparing the supplemental bundles of hair nor permanent in nature, enables the individual supplemental hairs of the bundle to be intertwined and bonded together prior to the application of the permanent cyanoacrylate adhesive component. The cyanoacrylate component may then more uniformly coat and permanently bond together the individual supplemental hairs of the bundle. Treated in this manner, the supplemental bundle provides enhanced resistance to shedding, and to chemical and physical degradation.

Another advantage to be found within the hair extension and thickening process of the present invention is that the supplemental bundle of hair is affixed to a person's natural hair by use of hot melt acrylic adhesive. The acrylic adhesive provides further resistance to chemical and physical degradation under typical wear and use conditions.

A further advantage to be found within the hair extension and thickening process of the present invention is that, when it is desired to remove the supplemental bundle of hair from the person's natural hair, a small amount of acetone is applied to the acrylic-coated junction. The acrylic and, sometimes, the cyanoacrylate adhesives are, thereby, dissolved and the hair can easily be separated. Should any residue remain in the person's natural hair, it may be completely and safely removed by wiping with additional, small amounts of acetone.

BRIEF DESCRIPTION OF THE DRAWINGS

The invention is better understood by reading the Detailed Description of the Preferred Embodiments with reference to the accompanying drawing figures, in which like reference numerals denote similar structure and refer to like elements throughout, and in which.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE PREFERRED EMBODIMENT

In describing the preferred embodiment of the present invention illustrated in the Figures, specific terminology is employed for the sake of clarity. The invention, however, is not intended to be limited to the specific terminology so selected, and it is to be understood that each specific element and step includes all technical equivalents which operate in a similar manner to accomplish a similar purpose. It will be appreciated that the process of the present invention may be varied as to configuration, and with regard to details of the steps presented and the materials employed, without departing from the scope of the basic invention as disclosed herein.

I. Preprocessing the Bundle of Supplemental Hair

Figure 1:
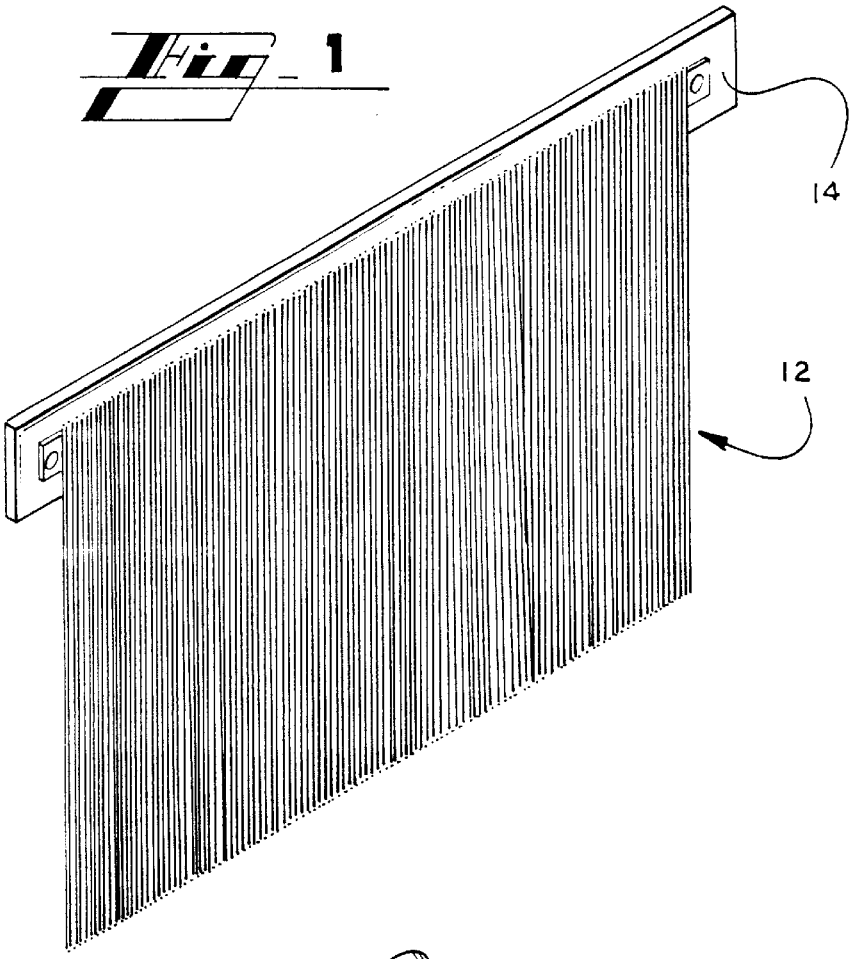
FIG. 1 is a perspective view of the weft of supplemental hair prepared in accordance with the preferred embodiment of the present invention.

Referring to FIG. 1, a large bundle of supplemental hair 12 is tightly secured, as by clamping or tacking, to a fixture 14. The large bundle is suspended approximately vertically to enhance subsequent processing. The preferred zone for further preparation in accordance with the instant process is found to be located approximately one inch below the weft, the weft being that area of the bundle of supplemental hair that is typically sewn together with thick thread.

Figure 2:
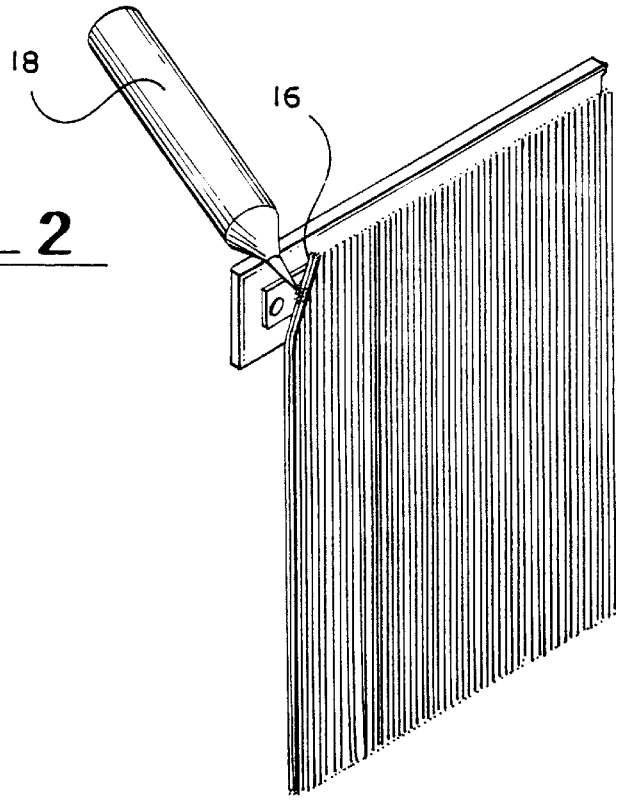
FIG. 2 is a perspective view demonstrating the method of application of the liquid latex adhesive component in accordance with the preferred embodiment of the present invention.
Figure 3:
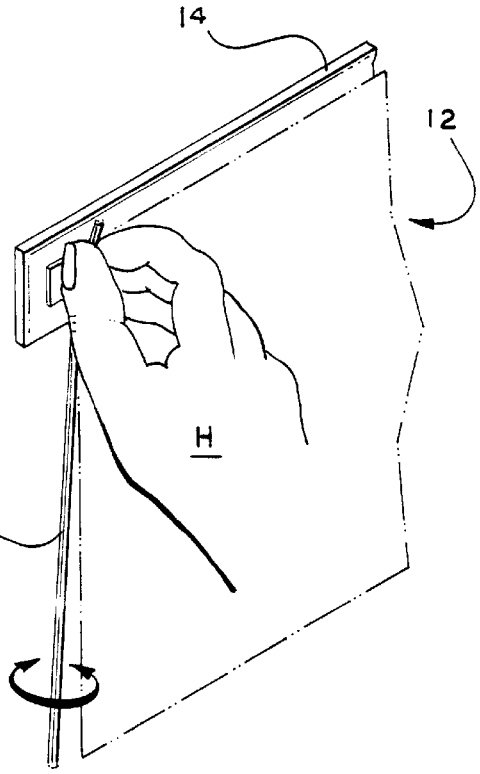
FIG. 3 is a perspective view demonstrating the method of intertwining the individual strands of hair within the bundle of supplemental hair in accordance with the preferred embodiment of the present invention.

As demonstrated in FIGS. 2 and 3, a small section, or bundle, of supplemental hair 16 is segregated from below the weft. The amount of hair so segregated should be approximately one-tenth ($1/10^{th}$) of an inch in diameter. While holding the bundle of supplemental hair 16 between the thumb and forefinger of hand H, a small drop of latex adhesive solution 18 (007 Bond™ Weave Creme, Sample Lab, Inc., Memphis, Tenn.) is added to the area which is located approximately one inch below the weft, as previously specified. Excess latex adhesive solution 18 should be removed, as by wiping with the fingers. As shown in FIG. 3, the area to which latex adhesive solution 18 was applied is rolled, as between the thumb and forefinger of hand H. This rolling motion should be repeated and continued until the area is smooth and completely bonded. No individual strands should be visible at the conclusion of this portion of the process. This process is repeated across the entire weft, with care being taken to ensure consistency with regard to the size of each bundle 16.

Figure 4:
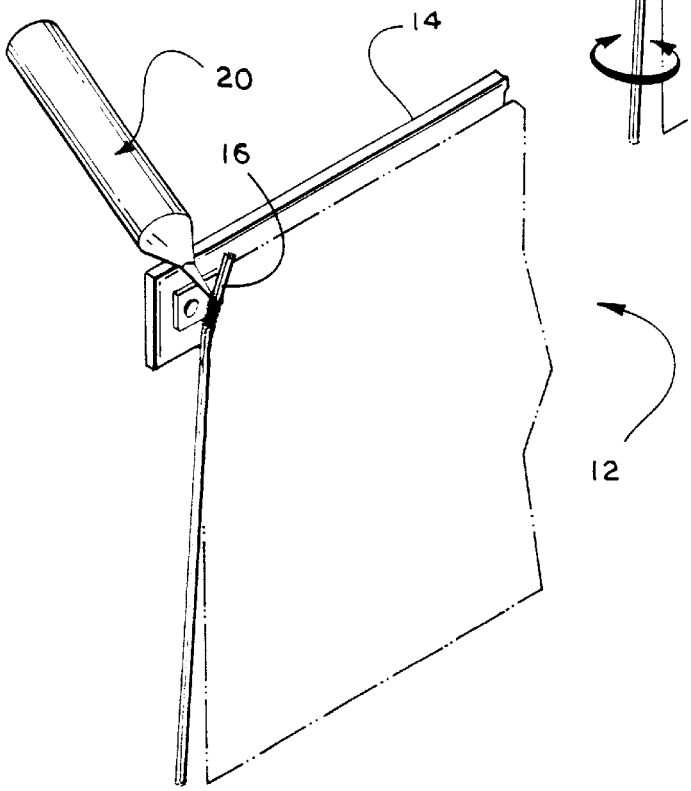
FIG. 4 is a perspective view demonstrating the method application of the liquid cyanoacrylate adhesive component in accordance with the preferred embodiment of the present invention.

Once the latex adhesive solution 18 is dry, and as best seen by reference to FIG. 4, each bundle 16 is, in turn, treated with a cyanoacrylate adhesive solution 20. A commercially available adhesive solution, like SuperGlue®, is found to be effective in this portion of the process. A small drop of cyanoacrylate adhesive solution 20 is applied over the zone of bundle 16 which was previously treated with latex adhesive solution 18. The cyanoacrylate adhesive solution 20 is to be uniformly applied about the entire circumference of bundle 16 in the specified treatment zone. The cyanoacrylate adhesive solution 20 is allowed to dry for approximately one hour.

Figure 5:
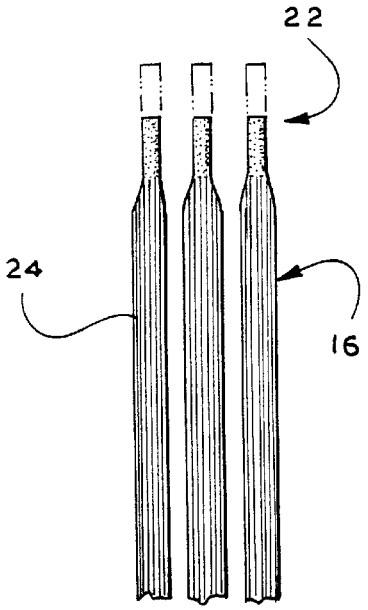
FIG. 5 is an elevation view of several bundles of supplemental hair prepared in accordance with the preferred embodiment of the present invention.

As shown in FIG. 5, the individual bundles 16 of supplemental hair are permanently separated from the weft, as by cutting with barber scissors, near the center of the previously adhesive-treated zone 22. The bundles 16 should be separated from the weft in a manner which will result in approximately one-eighth ($1/8^{th}$) inch of adhesive-treated, supplemental hair left above the loose strands 24. As they are cut, the adhesive-treated ends of bundles 16 may be arranged together, so that they may be conveniently banded for subsequent processing and use. Each bundle 16 may be combed to remove any tangles introduced during the above-described steps of the process.

II. Affixing the Bundle of Supplemental Hair

For best results, and especially with coarsely textured hair, the process of affixing, or infusing, the bundle of supplemental hair to the person's natural hair should be preceded by the steps of relaxing the hair to straighten it prior to the affixation steps. The hair should then be washed, conditioned, and allowed to dry. No oils should be added at this time.

Figure 6A:
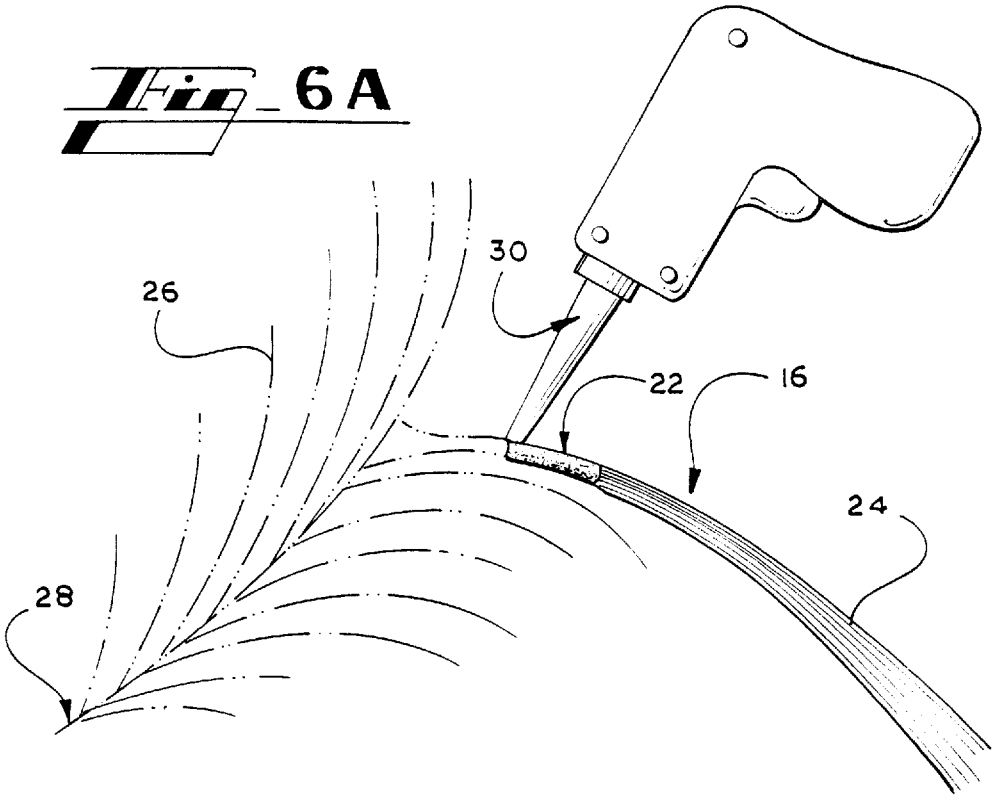
FIG. 6A is a perspective view demonstrating the method of affixing an individual bundle of supplemental hair to a person's natural hair in accordance with the preferred embodiment of the present invention; and, FIG. 6B is a perspective view demonstrating the method of removal of an individual bundle of supplemental hair from a person's natural hair in accordance with the preferred embodiment of the present invention.

The infusion process typically proceeds as follows. Starting from the back of the head and working forward, and as best seen with reference to FIG. 6A, the person's natural hair 26 is parted horizontally, as from ear-to-ear. Enough hair 26 is to be left on the first, or bottom, row to allow the hair above to adequately cover the infused area when the process is concluded. Enough hair typically is left to allow the person to pull the hair into a "pony tail" style with no exposure of the infused area.

Another row 28 is then parted approximately one-fifth ($1/5^{th}$) of an inch above the first row. This row 28 will be used to attach the bundles of supplemental hair 16. The infusion process proceeds by separating a small section of hair 26, approximately one-half of the thickness of the individual bundle of supplemental hair 16. While holding this section of the person's natural hair 26 adjacent a bundle of supplemental hair 16, as between the thumb and forefinger of hand H, a small portion of a heated acrylic-based bonding agent 30 is applied at the junction therebetween to effectuate the affixation of supplemental hair.

This junction is best formed at a position as close to the person's scalp as possible, taking care, of course, not to burn the scalp. A finger or shield may be used for this purpose. The junction is best formed, while the bonding agent 30 is still pliable, by pressing the junction firmly together. For best results, the junction may be rolled slightly as pressure is applied firmly in a motion toward the person's scalp. More bonding agent 30 may be applied, if necessary. When performed correctly, the final junction should have a solid "bead" close to the scalp. Any loose ends should appear blended together.

The infusion process, just described, is repeated across so much of row 28 as the stylist should desire. Another row, approximately one-fifth ($1/5^{th}$) of an inch above the previously infused row 28, is parted in a similar horizontal manner. This row, however, is not infused; rather, it is best left to cover the underlying infused row 28. The pattern of alternating infused row with non-infused row continues until such part of the person's entire head is infused as the stylist should desire. Adjustments in coverage of the infused areas, considering balance, fullness, and the like, may then be made by the stylist. Once the infusion process is completed, the hair may be styled as desired.

Typically, the bonding agent is allowed to cure for approximately twenty-four hours before next washing the hair or adding oils. After this period, the hair may be managed as usual.

Figure 6B:
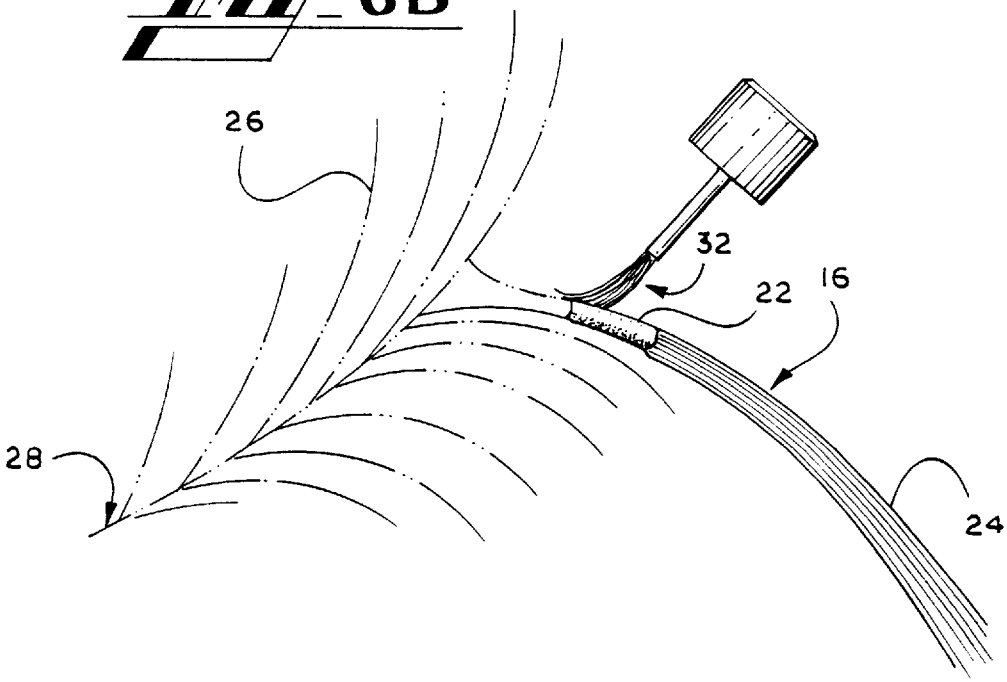

As illustrated in FIG. 6B, when it is desired to remove the infused supplemental bundles 16, a small amount of acetone 32 is applied to the acrylic-coated junction. The acetone is best applied as with a small brush or pliers dipped into the solution. The acrylic bonding agent 30 and, sometimes, the cyanoacrylate adhesive 20, is, thereby, dissolved and the hair can easily be separated. Should any residue remain in the person's natural hair, it may be completely and safely removed by wiping with additional, small amounts of acetone. In this manner, release and separation of the supplemental bundle 16 from the person's natural hair 26 is conveniently, safely, and cleanly achieved.

Thus, an advantage to be found within the hair extension and thickening process of the present invention is that the liquid latex adhesive component 18, which is neither harmful to the skin of the person preparing the supplemental bundles of hair nor permanent in nature, enables the individual supplemental hairs of the bundle to be intertwined and bonded together prior to the application of the permanent cyanoacrylate adhesive component 20. The cyanoacrylate adhesive component 20 may then more uniformly coat and permanently bond together the individual supplemental hairs of the bundle 16. Treated in this manner, the supplemental bundle 16 provides enhanced resistance to shedding, and to chemical and physical degradation.

Additionally, the acrylic bonding agent 30 provides further resistance to chemical and physical degradation under typical wear and use conditions. When it is desired to remove the supplemental bundle of hair 16 from the person's natural hair 26, a small amount of acetone 32 may be applied to the acrylic-coated junction. The adhesives at the junction are, thereby, dissolved and the hair can easily be separated. Should any residue remain in the person's natural hair, it may be completely and safely removed by wiping with additional, small amounts of acetone 32.

Having thus described exemplary embodiments of the present invention, it should be noted by those skilled in the art that the within disclosures are exemplary only and that various other alternatives, adaptations, and modifications may be made within the scope of the present invention. Accordingly, the present invention is not limited to the specific embodiments as illustrated herein, but is only limited by the following claims.

I claim:

1. A process for attaching supplemental hair to human natural hair, comprising the steps of:

(a.) coating one end of a bundle of supplemental hair with a liquid latex adhesive;

(b.) allowing said liquid latex adhesive to dry;

(c.) coating said one end of a bundle of supplemental hair with a liquid cyanoacrylate adhesive, said liquid cyanoacrylate adhesive being applied substantially over said dry latex adhesive;

(d.) allowing said liquid cyanoacrylate adhesive to dry;

(e.) aligning the adhesive coated end of said bundle of supplemental hair adjacent to, and substantially parallel with, a plurality of strands of said natural hair to form a junction;

(f.) coating said junction with acrylic thermosetting adhesive; and, (g.) allowing said acrylic thermosetting adhesive to harden.

2. The process of claim 1, further comprising the step of dividing said natural hair into a plurality of application zones prior to the step of coating said junction with acrylic thermosetting adhesive.

3. The process of claim 1, further comprising the step of covering the junction of said bundle of supplemental hair and said natural hair with natural or supplemental hair.

4. The process of claim 1, further comprising the step of removing said bundle of supplemental hair from said natural hair by application of acetone.

5. A process for extending the length of a person's natural hair with supplemental hair, comprising the steps of:

(a.) bundling a plurality of strands of supplemental hair, said bundle of strands of supplemental hair having a first end and a second end;

(b.) impregnating said first end of said bundle of strands of supplemental hair with liquid latex adhesive;

(c.) twisting said bundle of strands of supplemental hair so as to substantially intertwine them;

(d.) allowing said liquid latex adhesive to dry;

(e.) substantially coating said first end of said bundle of strands of supplemental hair with liquid cyanoacrylate adhesive;

(f) allowing said liquid cyanoacrylate adhesive to dry and bind said first end of said bundle of strands of supplemental hair;

(g.) aligning the adhesive coated end of said bundle of supplemental hair adjacent to, and substantially parallel with, a plurality of strands of said natural hair to form a junction;

(h.) coating said junction with acrylic thermosetting adhesive; and, (i.) allowing said acrylic thermosetting adhesive to harden, so as to bind said bundle of strands of supplemental hair to said natural hair.

6. The process of claim 5, further comprising the step of dividing said natural hair into a plurality of application zones prior to the step of coating said junction with acrylic thermosetting adhesive.

7. The process of claim 5, further comprising the step of covering the junction of said bundle of supplemental hair and said natural hair with natural or supplemental hair.

8. The process of claim 5, further comprising the step of removing said bundle of supplemental hair from said natural hair by application of acetone.

9. A hair extension process, comprising the steps of:

(a.) coating one end of a bundle of supplemental hair with a liquid latex adhesive;

(b.) twisting said bundle of strands of supplemental hair so as to substantially intertwine them;

(c.) allowing said liquid latex adhesive to dry;

(d.) coating said one end of a bundle of supplemental hair with a liquid cyanoacrylate adhesive, said liquid cyanoacrylate adhesive being applied substantially over said dry latex adhesive;

(e.) allowing said liquid cyanoacrylate adhesive to dry and bind said first end of said bundle of strands of supplemental hair;

(f.) aligning the adhesive coated end of said bundle of supplemental hair adjacent to, and substantially parallel with, a plurality of strands of said natural hair to form a junction;

(g.) coating said junction with acrylic thermosetting adhesive; and, (h.) allowing said acrylic thermosetting adhesive to harden, so as to bind said bundle of strands of supplemental hair to said natural hair.

10. The process of claim 9, further comprising the step of dividing said natural hair into a plurality of application zones prior to the step of coating said junction with acrylic thermosetting adhesive.

11. The process of claim 9, further comprising the step of covering the junction of said bundle of supplemental hair and said natural hair with natural or supplemental hair.

12. The process of claim 9, further comprising the step of removing said bundle of supplemental hair from said natural hair by application of acetone.

* * * * *